US007421218B2

(12) United States Patent
Gomi

(10) Patent No.: US 7,421,218 B2
(45) Date of Patent: Sep. 2, 2008

(54) IMAGE FORMING APPARATUS WITH SURFACE POTENTIAL DETECTION

(75) Inventor: Fumiteru Gomi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 329 days.

(21) Appl. No.: 11/250,507

(22) Filed: Oct. 17, 2005

(65) Prior Publication Data

US 2006/0083524 A1 Apr. 20, 2006

(30) Foreign Application Priority Data

Oct. 20, 2004 (JP) ..... 2004-305733

(51) Int. Cl.
*G03G 15/00* (2006.01)

(52) U.S. Cl. ..... 399/44; 399/48; 399/94

(58) Field of Classification Search ..... 399/44, 399/48, 94, 107
See application file for complete search history.

(56) References Cited

U.S. PATENT DOCUMENTS 7,113,712 B2 9/2006 Gomi ..... 399/48
2006/0083525 A1 4/2006 Gomi ..... 399/44

FOREIGN PATENT DOCUMENTS

JP 01231073 A * 9/1989
JP 11-265097 9/1999
JP 2004-78088 3/2004

* cited by examiner

*Primary Examiner*—David M. Gray
*Assistant Examiner*—Laura K Roth
(74) *Attorney, Agent, or Firm*—Fitzpatrick, Cella, Harper & Scinto

(57) ABSTRACT

An image forming apparatus having a heating device that is configured to heat an image bearing member so that the detection of the surface potential of the image bearing member can be controlled with greater stability. The image forming apparatus utilizes a surface potential detector and a temperature detecting member placed in positions at a precise distance relative to an exposure portion of the image bearing member, such that the stability of the surface potential detection can be improved. When a surface potential of the image bearing member is detected, it is possible to reduce the amount of change in the potential caused by carriers generated immediately after an exposure operation, and to reduce variations in detection of the surface potential caused by variations in the temperature, so that the surface potential can be controlled with greater stability.

6 Claims, 7 Drawing Sheets

IMAGE FORMING APPARATUS WITH SURFACE POTENTIAL DETECTION

BACKGROUND OF THE INVENTION

1. Field of the Invention

The present invention relates to an image forming apparatus of electrophotographic process such as a copying apparatus, a laser printer or a facsimile apparatus.

2. Related Background Art

An electrophotographic photosensitive member is required to have a sensitivity, electrical characteristics and optical characteristics matching an electrophotographic process to be adopted, and, particularly a photosensitive member for repeated use, of which surface is directly subjected to electrical and mechanical processes such as a charging, an image exposure, a toner development, a transfer to paper and a cleaning process, is required to have a durability capable of withstanding such processes.

In an image forming apparatus such as an electrophotographic apparatus (a copying apparatus or a printer), or an electrostatic recording apparatus, a corona charger or a roller charger is often employed as a charging apparatus for uniformly charging (including charge elimination) an image bearing member (charged member) such as an electrophotographic photosensitive member or an electrostatic recording dielectric member in a polarity and a potential required.

A corona charging method can reduce the electrical deterioration of the surface of the photosensitive member, in comparison with a roller charging method in which an AC component is contained in an applied voltage. In comparison with a corona charging in the corona charging method, a roller charging has a significantly smaller total amount of discharge products. However, in the roller charging method, a discharge current flows in a small space between the surface of the photosensitive member and the surface of the charging roller, thereby causing particles of a very high energy such as electrons or ions to repeat collisions with the surface of the photosensitive member, whereby the surface of the photosensitive member is subjected to a cleavage of molecular chains, thus being easily scrapable and damaged. Thus the surface layer of the photosensitive member is subjected to an electrical damage and a mechanical damage in case of the roller charging, but, in the corona charging utilizing a mild discharge, an electrical damage is scarce and a mechanical damage becomes predominant. Thus the corona charging method is superior for achieving a higher durability in the photosensitive member.

On the other hand, the corona charger generates a large amount of ozone products such as $NO_x$ in the primary charger (inside a shield) by the discharge of the corona charger. When the photosensitive drum is stopped and let to stand for a while after an image forming process, such ozone products react with a moisture on the photosensitive drum immediately under the charger to generate a nitrate compound or the like which remains on the drum. In a next image formation, because of an electroconductivity of such nitrate compound, the charging cannot be made to a desired potential only in an upper part of the drum that is positioned under the charger during the stopped period, thereby hindering a normal latent image formation and resulting in a phenomenon (pause memory) of a blotting or a lowered density of a line.

Therefore, for effectively discharging ozone products such as $NO_x$ generated by the discharge, and also for preventing a stain of the charger by flying toner in the apparatus, there are known methods of blowing air by a fan into the charger from the exterior of the apparatus and discharging air by an air exhaust duct from the charger to the exterior. Also in order to eliminate the influence of the conductivity of the ozone products such as $NO_x$ at a high humidity, there is often utilized a method of providing a heater within or around the photosensitive member thereby maintaining the surface of the photosensitive member equal to or higher than a predetermined temperature. In this manner the temperature fluctuation of the photosensitive member at the image formation can be significantly reduced.

In recent years, however, a higher image quality is required in color images and it becomes necessary to control the temperature of the photosensitive member with a higher precision. A potential reduction by an exposure after charging is dependent on the temperature of the photosensitive member, and a temperature change of 1° C. may induce a change of the potential as large as 2-3 V in the developed portion. In a recent color electrophotographic apparatus for which a higher stability and a higher image quality is required, a particularly stable latent image formation is essential. A time-dependent change in the contrast of the latent image should be maintained as small as possible, since it leads to a color change in the output image with an increase in the number of passed sheets.

In order to stabilize the potential in the exposed portion, there is required an improvement in the precision of the temperature of the photosensitive member in a position of a potential sensor, or a potential control capable of following the temperature change in the photosensitive member.

In order to cope with such situation, there is employed a method, as disclosed in Japanese Patent Application Laid-Open Nos. 2004-78088 and H11-265097, of detecting the temperature of the photosensitive member and executing a correction on an exposure amount or a charging potential, thereby stably controlling the potential of the exposed portion or the dark decay level which are dependent on the surface temperature of the photosensitive member.

However, in case the temperature measurement is executed in a portion of the photosensitive member easily showing a temperature fluctuation, the correcting condition may become inappropriate.

More specifically, the surface temperature of the drum is not uniform over the entire surface. For example, an external air blowing by a suction fan is required as explained in the foregoing, for example in case a corona charger is employed as the primary charger, and an air-blown portion shows a local temperature decrease during such air blowing. Also when the drum rotation is started, heat is dissipated to a low-temperature member such as an intermediate transfer member contacted at the primary transfer portion, so that a portion of the photosensitive drum after passing the primary transfer portion shows a local temperature decrease.

Therefore, in case a temperature detection for temperature control is executed in a position where the temperature becomes unstable by an external factor, a detected potential shows a fluctuation by the temperature dependence of the photosensitive member.

On the other hand, even with an improved precision in temperature, if the potential measurement is conducted in an exposed portion showing an instability in the potential, the detected potential shows a significant fluctuation by an external factor, thereby deteriorating the precision of the detected potential.

SUMMARY OF THE INVENTION

An object of the present invention is to reduce a fluctuation in a potential detected by a potential detecting member, regardless of the environment of image formation.

Another object of the present invention is to provide an image forming apparatus including:

an image bearing member;

electrostatic latent image forming means which exposes the image bearing member thereby forming an electrostatic latent image;

a temperature detecting member positioned in a downstream side of an image exposure position in a rotating direction of the image bearing member, for detecting a surface temperature of the image bearing member;

temperature control means which controls a temperature of the image bearing member, based on an output of the temperature detecting member;

a potential detecting member positioned in a downstream side of an image exposure position in a rotating direction of the image bearing member, for detecting a surface potential of the image bearing member; and control means which controls an electrostatic latent image forming condition, based on an output of the potential detecting member; and further satisfying conditions:

$Xd$>distance $Xe$ between the image exposure position and the potential detecting member>$2\times\tau\times PS\times Vc/V\mu\times Mc/M\mu$; and 0<distance $Xt$ between the image exposure position and the temperature detecting member<$50\times\tau\times PS\times Vc/V\mu\times Mc/M\mu$, wherein:

τ: time constant (sec) in a hole mobility measurement in a TF method;

PS: process speed (mm/sec):

Vc: latent image contrast (V) necessary for image formation;

Mc: thickness (cm) of charge transport layer in the photosensitive member;

Vμ: bias (V) applied to a specimen in the hole mobility measurement by the TF method;

Mμ: thickness (cm) of a charge transport layer of a specimen employed in the hole mobility measurement by the TF method; and Xd: distance (mm) of an image exposure portion and a developing device in a position opposed to the photosensitive member.

Still other objects of the present invention will become apparent from the following description.

DETAILED DESCRIPTION OF THE PREFERRED EMBODIMENTS

In the following, the present invention will be clarified in detail by an embodiment thereof.

Embodiment

In the following, a detailed description will be given on a photosensitive member to be employed in the present invention.

Figure 2:
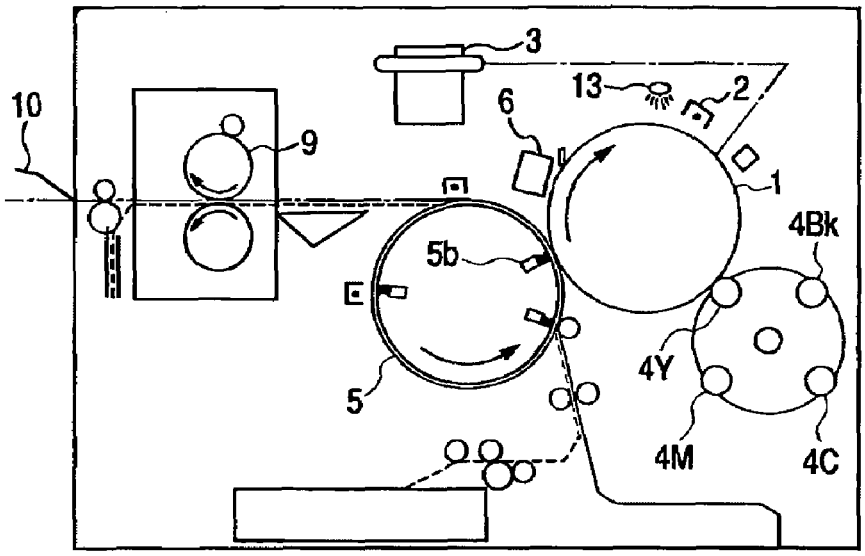
FIG. 2 is a schematic view of a full-color copying apparatus as an image forming apparatus in which the present invention is applicable.

FIG. 2 is a schematic view of a full-color copying apparatus, constituting an image forming apparatus of the present invention. This copying apparatus is basically so constructed as to read an original, separate color information thereof into colors of yellow (Y), magenta (M), cyan (C) and black (Bk), and forming images of respective colors in succession on a transfer material such as paper, thereby obtaining a full-color image on the transfer material.

Now referring to FIG. 2 for more details, the copying apparatus is provided, in a basic structure, with a photosensitive drum 1 constituting an image bearing member, around which provided are image forming means including a charger 2 constituting charging means which charges the photosensitive drum 1 at a predetermined potential, an optical scanning device 3 constituting exposure means, a rotary member supporting developing devices 4*y*, 4*m*, 4*c*, 4Bk as developing means of respective colors of yellow, magenta, cyan and black, an intermediate transfer member 5 and a transfer charger 5*b* constituting transfer means which transfers a toner image on the photosensitive drum 1 onto a transfer material, and a cleaner 6 constituting cleaning means for the photosensitive drum 1. In the present example, electrostatic latent image forming means including charging means and image exposure means.

In the following, there will be explained a process until a color image is formed on the transfer material. On the photosensitive drum 1 uniformly charged by the charger 2, image information of a first color (for example yellow) of the original is formed as a latent image by the laser beam optical apparatus 3. Thus formed latent image on the photosensitive drum 1 is developed into a toner image of a first color by a developing device 4*y* moved to a position opposed to the drum by a synchronized rotation of the rotary member supporting the developing devices (hereinafter called developing rotary), and such toner image is transferred (primary transfer) onto the intermediate transfer member 5. Then toner images are similarly transferred in succession and superposition onto the intermediate transfer member 5, and the toner images are collectively transferred (secondary transfer) onto the transfer material P conveyed from a sheet feeding cassette 7.

The photosensitive drum 1 after the primary transfer step is cleaned by the cleaner 6, then subjected to elimination of a residual charge by a pre-exposure lamp 13, and is used again for the image formation. Also the intermediate transfer member 5 after the secondary transfer is cleaned by a cleaner. The transfer material P after the transfer step is separated from the intermediate transfer member 5, then subjected to a fused mixing of the toner on the transfer material P, and is discharged to a tray 10.

Figure 1A:
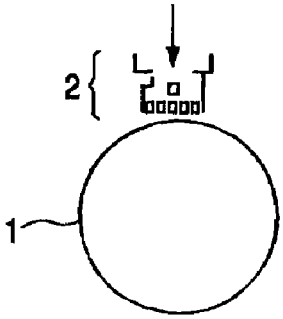
FIGS. 1A and 1B are schematic views of a corona charger 2 having a wire, a shield and a grid, as charging means for a photosensitive drum.
Figure 1B:
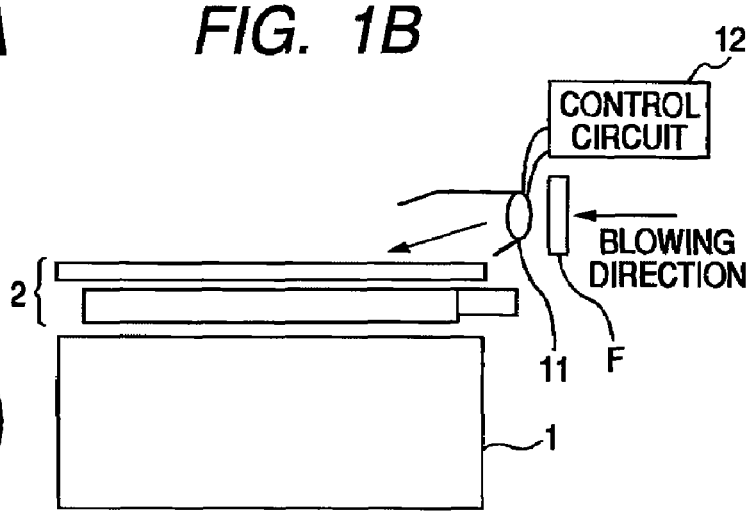

FIGS. 1A and 1B are schematic views of a corona charger 2 serving as the charging means for the photosensitive drum and provided with a wire, a shield and a grid. FIG. 1A shows a side view of the charger 2 and FIG. 1B shows a front view of the charger. An arrow indicates an air blowing direction in which a fan 11 blows air to the charger 2. Thus, fresh air from the exterior of the image forming apparatus is blown into the interior of the primary charger by a fan 11 provided in the image forming apparatus. The air blowing is conducted for following reason.

A discharge of the primary charger 2 generates a large amount of ozone products such as $NO_x$ with the primary charger 2 (inside the shield). When the photosensitive drum is stopped and let to stand for a while after an image forming process, such ozone products react with a moisture on the photosensitive drum immediately under the charger 2 to generate a nitrate compound or the like which remains on the drum. In a next image formation, because of an electroconductivity of such nitrate compound, the charging cannot be made to a desired potential only in an upper part of the drum that is positioned under the charger during the stopped period, thereby hindering a normal latent image formation and resulting in a phenomenon (pause memory) of a blotting or a lowered density of a line. An air blowing into the primary charger by the fan 11 allows to maintain the ozone products at a certain concentration or less inside the primary charger, thereby alleviating the pause memory. For this reason, an air blowing into the primary charger is always conducted during the operation of the image forming apparatus.

Also in a rotary axis of the photosensitive member, a heater is provided in order to maintain a surface temperature of the photosensitive member at a constant temperature higher than the temperature of the outside air. This heater is so constructed as to be capable of a certain temperature regulation even when a main power supply of the apparatus is turned off, thereby avoiding an influence of electroconductive ozone products such as $NO_x$ even after a standing in a high humidity situation during a night.

The heater 90 of the embodiment is constituted by a heater wire covered by a resin sheet, and is so provided as to be in contact with an internal surface of the photosensitive member 1.

Now there will be explained a temperature regulation executed by this heater 90. The temperature regulation on the drum surface is executed by providing a non-contact temperature sensor 102 (thermopile) in the vicinity of the drum surface. In the present embodiment, in order to maintain a constant temperature of 42.5° C., the power supply is turned on or off respectively when a temperature detected by the thermopile is lower or higher than 42.5° C., whereby a temperature control within a range of about ±2° C. can be realized by control unit 1000 including a temperature control unit. Such control can prevent an image streak, which is generated in a position under the charger after a standing of the drum with a surface temperature thereof at 40° C. or less in a high humidity environment.

Figure 6:
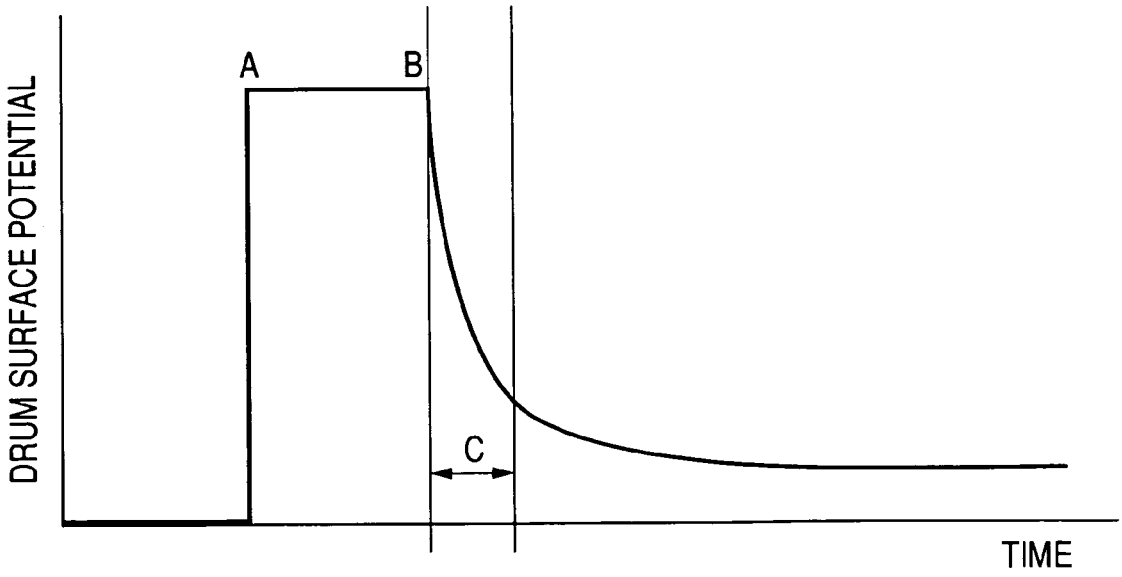
FIG. 6 is a schematic view showing a potential behavior on a drum surface from a charging thereof to a development in an example.

In the following, there will be explained a position of a drum surface potential sensor 101 constituting a surface potential detecting member. FIG. 6 schematically shows a potential behavior of the drum surface after a charging to a development, wherein the abscissa indicates time and the ordinate indicates a drum surface potential. In FIG. 6, B indicates an exposure timing, and the curve indicates a potential decay caused by generation of photocarriers by the exposure in a charge generation layer of the drum. The potential sensor 101, being provided for controlling a developing contrast in the developing position, should not execute a measurement in a position showing a large change such as an area C, but is required to execute the measurement in an area where the potential is almost stabilized after dropping, thereby enabling the potential control at the developing position. The potential sensor is also used for detecting a potential corresponding to a black portion of the image (image area) and a potential corresponding to a white background portion of the image (non-image area) at predetermined timings, for controlling a charging bias of the charging means and an exposure amount of the exposure means based on thus detected potentials.

Figure 7:
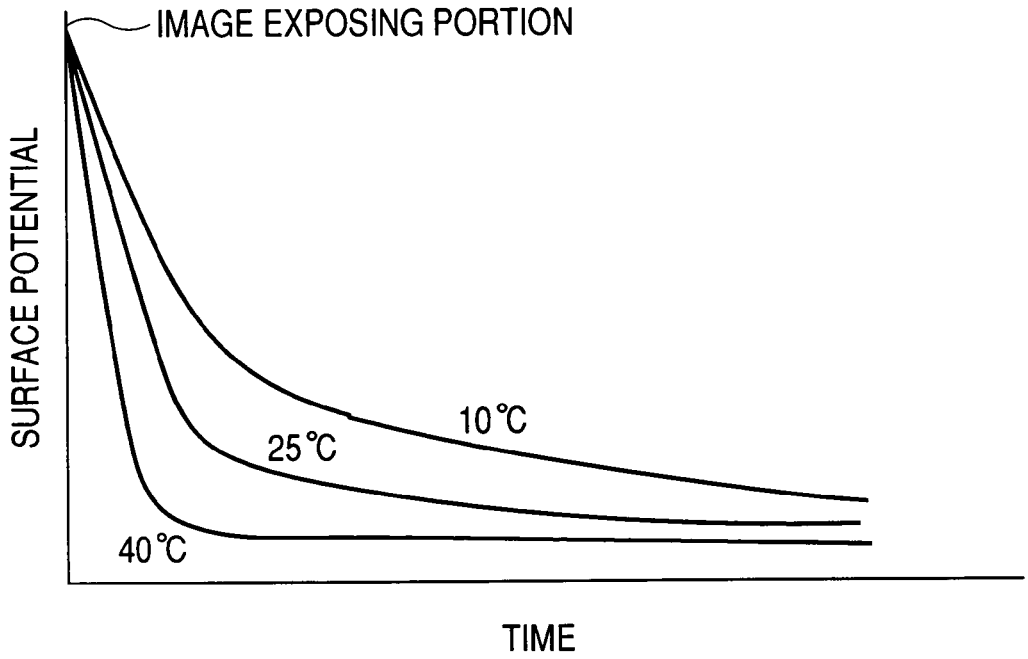
FIG. 7 is a schematic view showing a potential behavior at different temperatures in an example.

FIG. 7 shows a potential behavior at different temperatures, wherein the ordinates indicates a surface potential and the abscissa indicates a lapsed time. As will be apparent from FIG. 7, a position showing a stabilized potential has a strong dependence on the temperature of the drum surface and cannot be in general represented by a time or a distance. This is presumably because an amount of generated carriers and a moving rate of carriers (hereinafter represented as hole mobility) through a charge transport layer from the charge generation layer where they are generated to the drum surface are variable depending on the temperature. It is therefore necessary to understand these characteristics in order to specify a stable potential region. In the following there will be explained a method of measuring the hole mobility, which is generally employed as one of photosensitive characteristics of the drum in the manufacture process thereof.

In the present embodiment, the hole mobility was measured by a time-of-flight (TF) method. The electrophotographic photosensitive member employed in the present invention is constituted by forming, on an aluminum substrate, a charge injection inhibition layer, a charge generation layer, a charge transport layer and a surface protective layer in succession, in which the aluminum substrate can be used as a grounding electrode. A specimen for measuring the hole mobility was obtained by cutting the electrophotographic photosensitive member into a dimension that can be accommodated in a vacuum evaporating chamber, and by vacuum evaporating gold as a semi-transparent layer of a thickness of about 200-300 Å on the surface of the electrophotographic photosensitive member, namely on the surface protective layer in the present invention. This specimen, after a voltage application, was subjected to a pulsed light irradiation with a laser diode of a wavelength of 680 nm to generate a charge in the charge generation layer, and a generated transient current form was observed with a high-speed current amplifier (Keithley 428) and a digital oscilloscope (Tektronix TDS 420A). A transit time was judged by a method of executing a logarithmic conversion of current (i)–time (t) relationship and observing a flexion point of the obtained curve (Scher-Montroll method).

In the electrophotographic photosensitive member of the present embodiment, a hole mobility μt ($cm^2/V\cdot sec$) under an electric field of $3\times10^5$ V/cm. The hole mobility is finally represented by a following equation:

$$\mu t = M\mu^2/V\mu\cdot\tau(cm^2/V\cdot sec).$$

Figure 3:
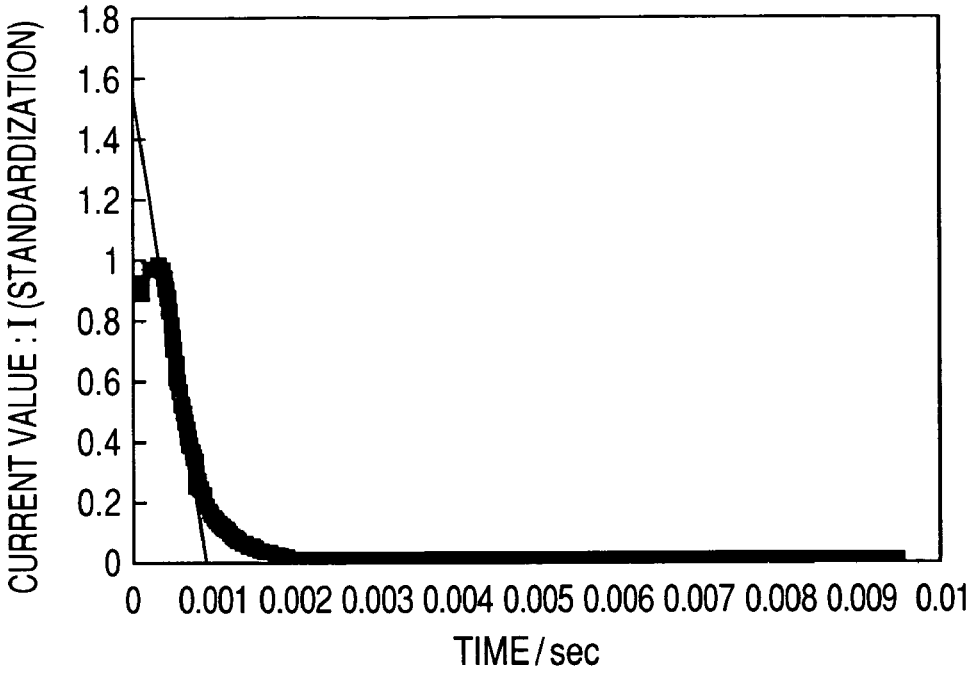
FIG. 3 is a chart showing a behavior in time of a current flowing in a photosensitive layer after a pulsed light irradiation on a photosensitive member.
Figure 4:
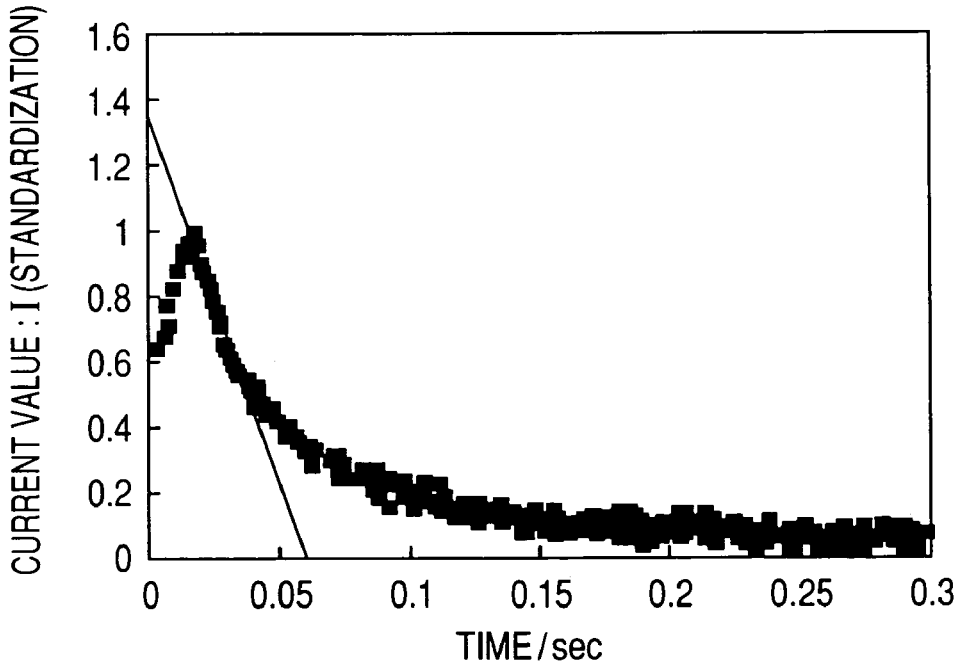
FIG. 4 is a chart showing a behavior in time of a current flowing in a photosensitive layer after a pulsed light irradiation on a photosensitive member.
Figure 8:
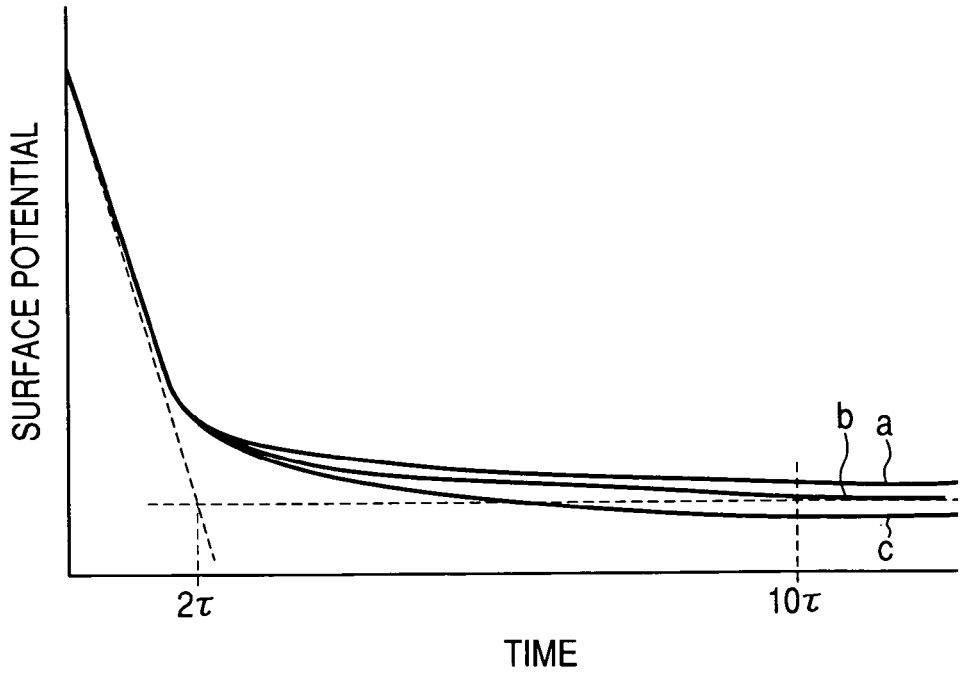
FIG. 8 is a schematic view showing a potential behavior after an exposure in an example.

A current-time relationship in an actual scale at the determination of the hole mobility μt, namely a behavior in time of a current in the photosensitive layer after a pulsed light irradiation on the photosensitive member, is shown in FIGS. 3 and 8. In these charts, a current peak is normalized to unity. In FIGS. 3 and 4, an inclination of the curve attenuating from a current peak corresponds to a charge moving to the surface with a delay, after an initial group of charge reaches the surface. In comparison with FIG. 3, FIG. 4 shows a smaller inclination, thus indicating a state where the charge moves to the surface over a longer period. This means that a photosensitive member as shown in FIG. 4 has a higher proportion of charge which cannot eventually move to the surface, so that the potential sensor has to be positioned closer to the developing device. A twice time of the time constant τ of the curve showing an attenuation from the current peak is defined as a point where a center of gravity of the carriers arrives, and a study on such current attenuation indicates that this point marks a transfer point from a region showing a large change in the drum surface potential after the exposure, to a stable region showing little potential change. More specifically, it is rendered possible to detect a stable potential and, based thereon, to regulate a grid bias of the charger and an image exposure amount for regulating the developing bias, by positioning the potential sensor within a range defined by:

$Xd > Xe$ (distance between the image exposure position and the potential detecting member) $> 2\times\tau\times PS\times Vc/V\mu\times Mc/M\mu$, wherein:

τ: time constant (sec) in a hole mobility measurement in a TF method;

PS: process speed (mm/sec):

Vc: latent image contrast (V) necessary for image formation;

Mc: thickness (cm) of charge transport layer in the photosensitive member;

Vμ: bias (V) applied to a specimen in the hole mobility measurement by the TF method;

Mμ: thickness (cm) of a charge transport layer of a specimen employed in the hole mobility measurement by the TF method; and Xd: distance (mm) of an image exposure portion and a developing device in a position opposed to the photosensitive member.

The electric field applied to the specimen at the measurement by the TF method or the thickness of the charge transport layer to be employed can be converted, with a correction, to a τ value to be actually used.

Figure 5:
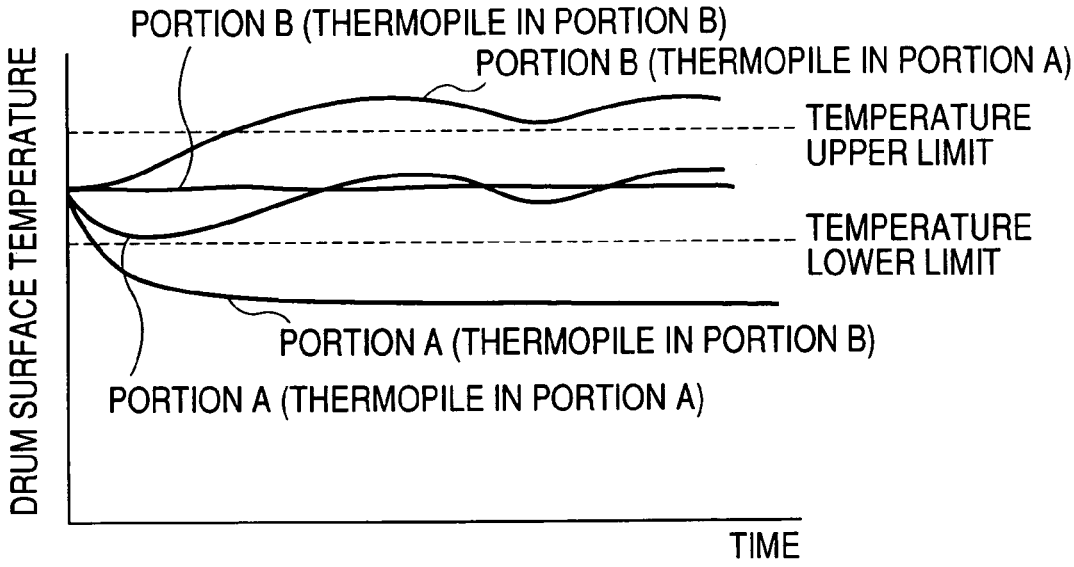
FIG. 5 is an explanatory chart showing difference in a temperature behavior in an example in respective positions when a sensor is provided in a position A showing a large temperature decrease by the influence of a fan and in a position B showing a stable temperature.

In the following there will be explained positioning of the thermopile constituting the temperature detecting member. The aforementioned temperature control allows to maintain the temperature at the detecting position by the thermopile within a certain temperature range, but there are various temperature-varying factors on the drum periphery. Also in case the power supply is turned off when the temperature detected by the thermopile exceeds a target temperature, the temperature increase does not stop immediately by a heat capacity of the drum, thereby usually causing an overshoot by an excessive heat amount. It is therefore difficult to control the entire drum surface constantly at a same temperature. For example, during an operation of the air-blowing fan to the primary charger, an air-blown portion of the drum surface shows a temperature decrease, but a portion not subjected to the air blowing maintains its temperature. Also the drum surface temperature becomes locally lowered after passing the primary transfer portion, because of the heat dissipation to the intermediate transfer member. Therefore, depending on the temperature detecting position, the required temperature control is not attained in other areas. FIG. 5 shows a difference in the temperature behavior in respective positions when a sensor is provided in a position A showing a large temperature decrease by the influence of a fan and in a position B showing a stable temperature. Thus, when the thermopile is provided in the position B, the temperature at A is lowered by the influence of the fan and becomes lower than the lower limit value. Also when the thermopile is provided in the position A, as the heater is turned on immediately when the temperature at A starts to lower, the temperature at B shows an increase thereby possibly exceeding the upper limit value.

In the temperature control on the drum surface, an upper limit is determined by tolerances for a breakage or a failure of an electronic device or a drive system of the apparatus by a temperature increase in the apparatus and for a deterioration of developer. Also a lower limit is determined in consideration of generation of an image streak. More specifically, it is estimated, when the drum surface temperature is lowered, that an ambient relative humidity is elevated to cause a moisture absorption in the electroconductive substance such as $NO_x$ on the drum surface thereby facilitating a lateral flow of the electrostatic charge constituting the latent image. Therefore, a position requiring a strict control of the drum surface temperature so as not to exceed the upper limit is difficult to specify because indispensable components, such as functional parts, developer, mechanical components and electronic components, are inevitably present around the photosensitive drum, but, a lower limit temperature has to be maintained within a range from a position of latent image formation to a position where an image is formed by a development, and within an image area excluding an end portion where the image is actually not formed, namely within a range where the desired latent image is to be maintained without causing a lateral flow.

It is however found that an effective range exists in controlling the drum surface temperature by the thermopile, in consideration of the aforementioned temperature dependence of the behavior of the drum surface potential after the exposure. In general, a mechanism for detecting the drum surface potential by the aforementioned potential sensor and executing a control in order to obtain the necessary developing contrast is preferably operated in a timing not linked with the image formation. More specifically, a latent image formation under predetermined charging and exposure conditions for the purpose of control is naturally not possible in an image area. Also so-called sheet interval in a continuous image formation is usually limited to a narrow gap in order to secure a copy speed. Such gap is insufficient for a stabilization of a high-voltage output, which generally requires about 100 ms after switching of the charging bias. Also even in case a latent image for measuring an exposed potential under a predetermined exposure condition is formed within such sheet interval, the potential of such latent image within such narrow gap cannot be read exactly since the potential sensor has a certain measuring angle. It is therefore only possible, within such sheet interval, to detect an unexposed charged potential under the charging condition selected for the image formation thereby controlling the fluctuation in the charged potential in a simplified manner. Therefore, the potential control is executed in a post-rotation after the image formation or in a regulation mode at the start of power supply in the main body, and is preferably executed as least frequently as possible, in order to maintain the productivity of the apparatus.

Therefore, in order to maintain a stable latent image formation without executing the potential control for a period as long as possible after the latent image contrast is once regulated by the potential control, it is preferable to maintain, at a stable state, the drum surface temperature that has a significant influence on the potential change after the exposure. Therefore the position of the sensor for detecting the drum surface temperature is important.

FIG. 8 schematically shows the potential behavior after the exposure. At and after 2τ, most of the generated charge has reached the drum surface and the potential decrease thereafter is very slight, as explained before. However the recent full-color high-quality apparatus is said to require an image hue stability corresponding to a fluctuation as small as ΔE<2−5 in the L*a*b* color presentation system, and, by converting such fluctuation into potential in consideration of the developing characteristics, even a potential fluctuation of only about 10 V is not permitted. Thus, a temperature stabilization is required because, even after 2τ, the potential behavior becomes different by about several volts by a temperature change. In FIG. 8, a, b and c show potential changes in case where the temperature is constant at 35° C. until 2τ and thereafter changes to 30, 35 and 40° C. respectively. A final potential difference of 8 V was observed at the developing position, between the cases a and c. The reason for the influence of the drum surface temperature after 2τ on the potential behavior thereafter is not yet clear, but is estimated as follows.

Figure 10:
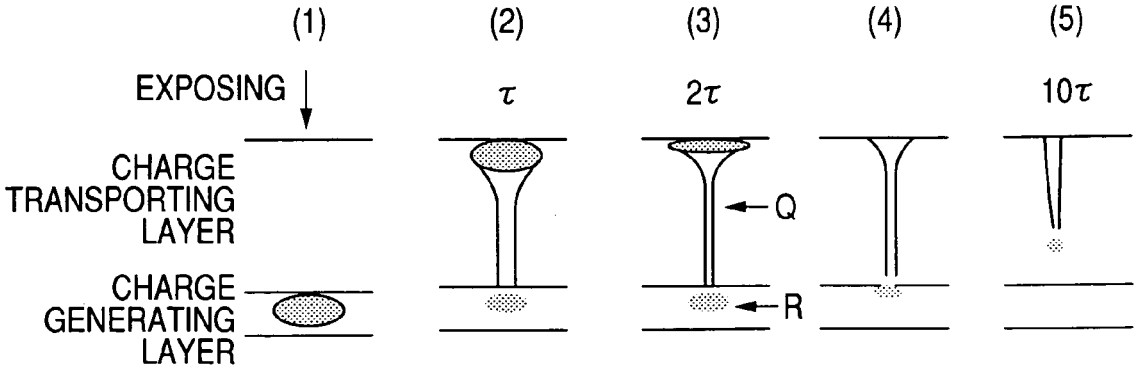
FIG. 10 is a schematic view showing generation and displacement of carriers after an exposure.

FIG. 10 is a schematic presentation of generation and displacement of the carriers after the exposure, wherein shown are (1) a state of carrier generation by an exposure, (2) a state of arrival of a front end of the carriers, (3) a state of arrival of a center of gravity of the carriers, and (4) and (5) states thereafter. As the potential is finally saturated at a point where all the carriers generated in the state (1) reach the drum surface, it is estimated to depend on the temperature at the carrier generation. However, a displacement rate of the carriers after 2τ, represented by Q in FIG. 10, is considered to depend on the temperature thereafter, thereby changing the inclinations a, b and c in FIG. 8. The final potential is still not affected, but the finally reached potential is assumed to become different because of a temperature dependence in an amount R of the carriers that continue to be slightly generated even after the exposure and in a dark decay. Such temperature dependence is found to be present, in a measurement by local air-blowing or heating under temperature monitoring in various positions on the drum surface, within a range of 50τ in the drum surface temperature before 2τ, and it is found that a sufficient stability in potential can be secured by maintaining a constant temperature in such range. It is also found, from Table 1, that a more effective result can be obtained within a range of 10τ.

Based on the foregoing, it is possible to maintain the generation amount and the displacement speed of the carriers, sensitive to temperature, at a stable level thereby maintaining a stable drum surface potential in the developing position, in case a distance Xt of the surface temperature detection means for the photosensitive member from the image exposure position satisfies a relation:

$$0<Xt<50\times\tau\times PS\times Vc/V\mu\times Mc/M\mu,$$ wherein:

τ: time constant (sec) in a hole mobility measurement in a TF method;

PS: process speed (mm/sec):

Vc: latent image contrast (V) necessary for image formation;

Mc: thickness (cm) of charge transport layer in the photosensitive member;

Vμ: bias (V) applied to a specimen in the hole mobility measurement by the TF method;

Mμ: thickness (cm) of a charge transport layer of a specimen employed in the hole mobility measurement by the TF method; and Xd: distance (mm) of an image exposure portion and a developing device in a position opposed to the photosensitive member, and more preferably a relation:

$$0<Xt<10\times\tau\times PS\times Vc/V\mu\times Mc/M\mu.$$

Figure 9:
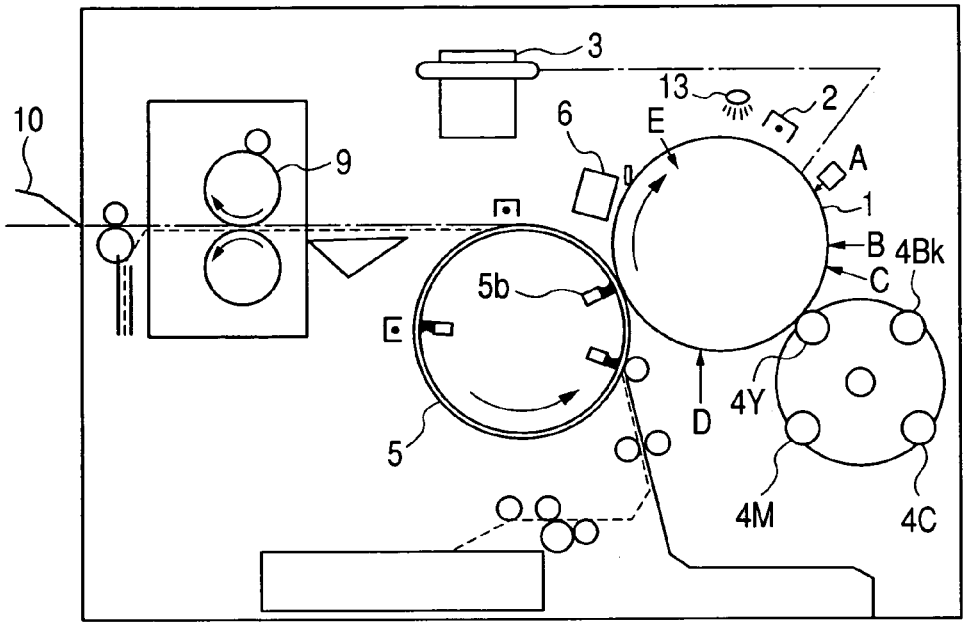
FIG. 9 is a schematic view showing a point of drum surface temperature measurement in an example.

Table 1 shows a potential fluctuation in the developing position in the present embodiment, in 20 intermittent image outputs with the thermopile provided in positions A-E and with the drum surface temperature set at 25, 35 or 45° C., and FIG. 9 shows the positions of the sensor, at the FT method measurement at 25, 35 or 45° C., wherein A corresponds to 2τ, A' corresponds to 10τ, and B and C correspond to before and after 50τ. τ was selected as 2.9 msec at 25° C., 2.5 msec at 35° C. and 2.0 msec at 45° C. at Vμ=150 V, and Mμ=25 μm. Also there were employed a process speed (the circumferential speed of an image bearing member during image formation) of 300 ms, and a charged potential of −600 V at the image formation, and an image exposure amount was so determined that an exposed potential became −200 V.

The used drum had Mc of 25 μm. The developing position was selected at 120 mm from the exposure portion. It can be observed that stabler potentials could be obtained at A, A' and B closer than 50τ to the exposure portion.

TABLE 1

(unit in −V)

| | 25° C. | | 35° C. | | 45° C. | | Δ |
|---|---|---|---|---|---|---|---|
| | min. | max. | min. | max. | min. | max. | A.V. |
| A | 195 | 198 | 186 | 190 | 175 | 180 | 4.0 |
| A' | 195 | 198 | 186 | 191 | 175 | 180 | 4.3 |
| B | 195 | 199 | 185 | 191 | 175 | 181 | 5.3 |
| C | 194 | 202 | 182 | 192 | 173 | 183 | 9.3 |
| D | 190 | 205 | 179 | 194 | 170 | 185 | 15.0 |
| E | 190 | 206 | 179 | 195 | 170 | 186 | 16.0 |

Figure 11:
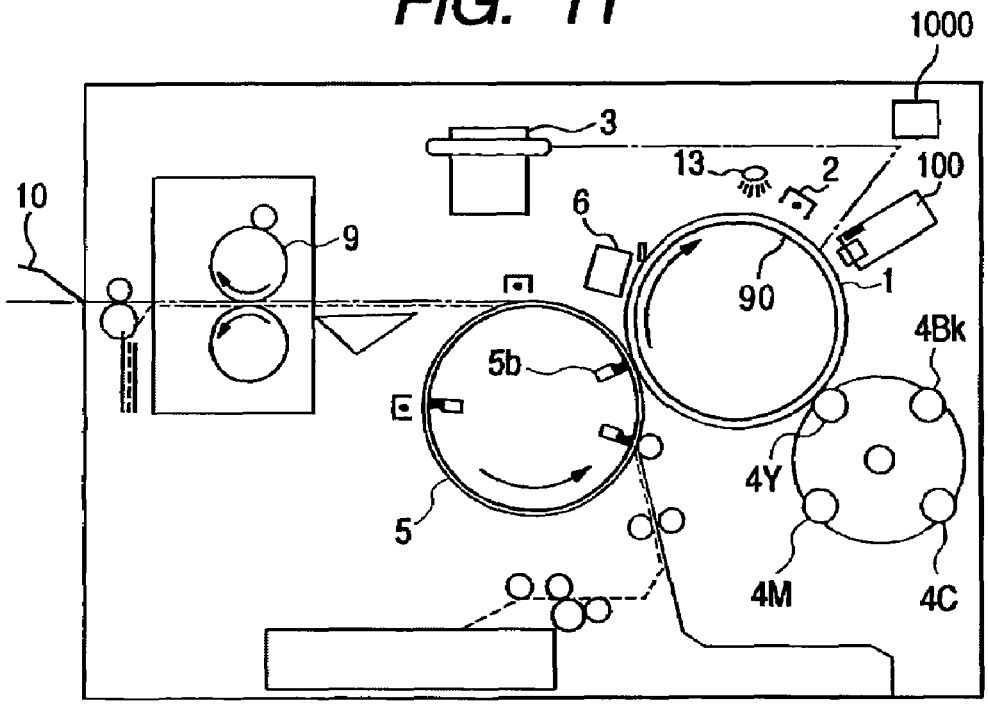
FIG. 11 is a schematic view showing an arrangement about a photosensitive member in an image forming apparatus employed in an example.
Figure 12:
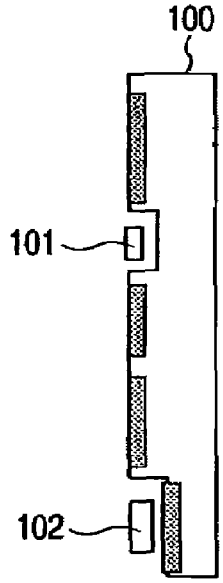
FIG. 12 is a schematic view showing an air duct portion employed in an example, seen from a direction of a normal line to the drum.
Figure 13:
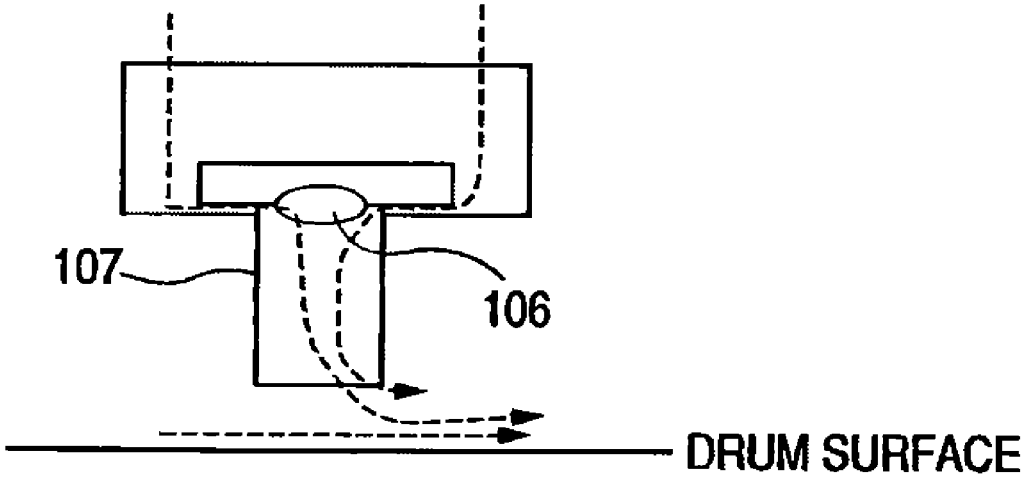
FIG. 13 is a schematic view showing a non-contact temperature detection employed in an example.

FIG. 11 shows an arrangement around the photosensitive member in an image forming apparatus employed in an embodiment. At a downstream side of the exposure portion, there is provided an air duct for cleaning by sucking the air in the primary charger, containing discharge products such as ozone. The thermopile 102 and the potential sensor 101 are mounted in the same position as the air duct 100. FIG. 12 is a view of the air duct portion, seen from a direction of a normal line. A non-contact temperature sensor is to measure a temperature of a detected substance by detecting an infrared light therefrom, and a stain in a light-receiving portion of such sensor causes an erroneous detection. In the present embodiment, therefore, a tubular dust-preventing cover is mounted around the sensor as shown in FIG. 13, and a circular aperture at the front end is positioned close to the drum surface. As an air flow crosses the circular aperture at the front end of the dust-preventing cover 107, there is generated a pressure difference from the interior of the tube, thereby generating a positive pressure inside the tube. There is thus generated an air flow as indicated by an arrow in the drawing to prevent a staining of the light-receiving face 106 of the sensor, thereby enabling a stable image formation over a prolonged period.

Other Embodiments

As another embodiment of the invention, there can be conceived a situation in which a heater is not provided inside the photosensitive drum, whereby the photosensitive member cannot be temperature controlled. A potential sensor and a thermopile are provided in similar positions, and a potential detected by the potential sensor and a surface temperature at the detection are memorized. Thereafter, a stable density can be maintained, without potential detection over a certain period, by calculating a current potential based on a detected temperature and a potential change per temperature of 1° C. stored in advance, and executing a feedback on the contrast of the latent image. It is also possible to calculate the potential based on a detected temperature and a pre-stored table indicating correspondence between temperature and potential.

In the following, a potential control will be explained in more detail. The main body of the apparatus is provided, in addition to an ordinary image forming operation, with a potential control mode which is executed at a predetermined timing, for example at the start of power supply or after the image forming operation. In such potential control mode, the charger is set at a grid bias of −400 V, and an exposed potential at such charged potential and with a predetermined exposure amount. Then a similar measurement is conducted with a grid bias of −700 V. In such operation, a temperature detected by the thermopile is also stored. A necessary development contrast is determined according to a temperature-humidity table stored in advance in storage means. Then there is calculated a grid bias capable of providing the aforementioned necessary contrast, based on the latent image contrasts measured at the grid biases of −400 V and −700 V, and assuming that the charged potential and the exposed potential change linearly between the grid biases of −400 V and −700 V.

An image forming operation can be executed with thus obtained grid output, and, in case the temperature detected by the thermopile becomes different from the value stored in advance, the optimum grid bias can be calculated by control unit 1000, again from the necessary contrast, after correcting the exposed potentials at the grid biases of −400 V and −700 V by a value obtained by multiplying such temperature difference with a potential changer per 1° C.

In case of such potential correcting control, the potential sensor and the thermopile are most preferably provided at the same position, since measurements conducted at closer positions enable more direct potential correction following a temperature change.

The present invention allows to reduce a fluctuation in the potential detected by the potential detecting member, regardless of the environment of image formation.

The present embodiment has been explained by an image forming method in which toner images of plural colors are formed by a single drum, but a similar effect can be obtained also in a tandem process having plural photosensitive drums and forming toner images respectively on such photosensitive drums.

The present invention can also provide a similar effect on a method in which a toner image on a photosensitive drum is transferred onto an intermediate transfer member.

The present invention has been explained by embodiments thereof, but the present invention is not limited to such embodiments and is subject to any and all modifications within the technical scope of the invention.

This application claims priority from Japanese Patent Application No. 2004-305733 filed on Oct. 20, 2004, which is hereby incorporated by reference herein.

What is claimed is:

1. An image forming apparatus comprising:

an image bearing member;

an electrostatic latent image forming device configured to expose the image bearing member thereby forming an electrostatic latent image;

a temperature detecting member positioned in a downstream side of an image exposure position in a rotating direction of the image bearing member, for detecting a surface temperature of the image bearing member;

a heating device configured to heat the image bearing member;

a temperature control unit, configured to control the heating device, for controlling a temperature of the image bearing member, based on an output of the temperature detecting member;

a potential detecting member positioned in a downstream side of the image exposure position in a rotating direction of the image bearing member, for detecting a surface potential of the image bearing member; and a control unit configured to control an electrostatic latent image forming condition, based on an output of the potential detecting member, wherein Xd> a distance Xe between the image exposure position and a position of the potential detecting member>$2\times\tau\times Vps\times Vc/V\mu\times Mc/M\mu$; and 0< a distance Xt between the image exposure position and a position of the temperature detecting member<$50\times\tau\times Vps\times Vc/V\mu\times Mc/M\mu$, wherein:

τ: time constant (sec) in a hole mobility measurement of a specimen obtained by a time-by-flight method;

Vps: a circumferential speed of the image bearing member during image formation (mm/sec);

Vc: a latent image contrast (V) necessary for image formation;

Mc: a thickness (cm) of charge transport layer in the image bearing member;

Vμ: a bias (V) applied to a specimen in the hole mobility measurement obtained by the time-by-flight method;

Mμ: a thickness (cm) of a charge transport layer of the specimen employed in the hole mobility measurement obtained by the time-by-flight method; and Xd: a distance (mm) of an image exposure portion and a developing device from a position opposed to the image bearing member.

2. An image forming apparatus according to claim 1, wherein said distance Xt satisfies the following relation:

$$0<Xt<10\times\tau\times Vps\times Vc/V\mu\times Mc/M\mu.$$

3. An image forming apparatus according to claim 1, wherein the electrostatic latent image forming device includes a charger which charges the image bearing member and an exposing device which exposes the charged image bearing member.

4. An image forming apparatus according to claim 1, wherein the potential detecting member detects a potential of an image forming area on the image bearing member.

5. An image forming apparatus according to claim 1, wherein the temperature detecting member detects a temperature of an image forming area on the image bearing member.

6. An image forming apparatus according to claim 1, wherein the temperature detecting member is not in contact with the image bearing member.

* * * * *

UNITED STATES PATENT AND TRADEMARK OFFICE

CERTIFICATE OF CORRECTION

PATENT NO. : 7,421,218 B2
APPLICATION NO. : 11/250507
DATED : September 2, 2008
INVENTOR(S) : Fumiteru Gomi It is certified that error appears in the above-identified patent and that said Letters Patent is hereby corrected as shown below:

ON THE TITLE PAGE ITEM -56- References Cited, FOREIGN PATENT DOCUMENTS:

"JP 01231073 A * 9/1989" should read --JP 01-231073 A * 9/1989--.

COLUMN 1:

Line 31, "comparison" should read --comparison,--.

COLUMN 2:

Line 5, "member" should read --member,--.
Line 31, "such" should read --such a--.

COLUMN 3:

Line 10, "member" should read --member,--.

COLUMN 4:

Line 56, "including" should read --includes--.

COLUMN 5:

Line 25, "following" should read --the following--.
Line 29, "a while" should read --awhile--.
Line 64, "off respectively" should read --off, respectively,--.

COLUMN 6:

Line 28, "indicates" should read --indicate--.

COLUMN 8:

Line 15, "increase" should read --increase,--.
Line 26, "surface" should read --surface,--.
Line 40, "is however" should read --is, however,--.
Line 56, "in case" should read --in a case where--.
Line 63, "formation" should read --formation,--.

UNITED STATES PATENT AND TRADEMARK OFFICE

CERTIFICATE OF CORRECTION

PATENT NO. : 7,421,218 B2
APPLICATION NO. : 11/250507
DATED : September 2, 2008
INVENTOR(S) : Fumiteru Gomi It is certified that error appears in the above-identified patent and that said Letters Patent is hereby corrected as shown below:

COLUMN 9:

Line 14, "However" should read --However,--.
Line 25, "40°C." should read --40°C.,--.
Line 56, "level" should read --level,--.

Signed and Sealed this

Tenth Day of February, 2009

JOHN DOLL
*Acting Director of the United States Patent and Trademark Office*